United States Patent [19]

Fiarman et al.

[11] Patent Number: 4,505,218

[45] Date of Patent: Mar. 19, 1985

[54] TAMPER-INDICATING SEAL

[75] Inventors: Sidney Fiarman, Port Jefferson; Michael F. Degen, Patchogue; Henry F. Peters, Brookhaven, all of N.Y.

[73] Assignee: United States of America as represented by the United States Department of Energy, Washington, D.C.

[21] Appl. No.: 408,091

[22] Filed: Aug. 13, 1982

[51] Int. Cl.[3] ..... B65D 85/02; B65D 90/48

[52] U.S. Cl. ..... 116/200; 116/215; 206/497

[58] Field of Search ..... 206/497, 534, 459; 116/307, 200, 214, 215; 220/214; 215/246; 137/384

[56] References Cited

U.S. PATENT DOCUMENTS

| | | | |
|---|---|---|---|
| 1,821,140 | 9/1931 | Carroll | 116/215 |
| 2,121,041 | 6/1938 | Morgan | 215/246 |
| 2,246,001 | 6/1941 | Powers | 116/200 |
| 2,418,436 | 4/1947 | Talbot | 116/200 |
| 2,939,597 | 6/1960 | Greene | 116/200 |
| 4,005,777 | 2/1977 | Marantz | 206/497 |
| 4,184,148 | 1/1980 | Smagala-Romanoff . | |

*Primary Examiner*—Charles Frankfort
*Assistant Examiner*—Denis E. Corr
*Attorney, Agent, or Firm*—Vale P. Myles; Paul A. Gottlieb; Judson R. Hightower

[57] ABSTRACT

There is disclosed a tamper-indicating seal that permits in the field inspection and detection of tampering. Said seal comprises a shrinkable tube having a visible pattern of markings which is shrunk over the item to be sealed, and a second transparent tube, having a second visible marking pattern, which is shrunk over the item and the first tube. The relationship between the first and second set of markings produces a pattern so that the seal may not be removed without detection.

12 Claims, 3 Drawing Figures

TAMPER-INDICATING SEAL

BACKGROUND OF THE INVENTION

The U.S. Government has rights in this invention pursuant to Contract Number DE-AC02-76CH00016, between the U.S. Department of Energy and Associated Universities, Inc.

This invention relates to seals for items such as valves, padlocks, electronic circuitry, etc., and more particularly to tamper-indicating seals which are not easily removed and replaced without detection.

There is an existing need for a means to seal items such as valves, padlocks, etc., in such a manner that any tampering with such item may be readily detected by inspection. This need is particularly pressing in the field of nuclear safeguards where large amounts of nuclear materials stockpiled in commercial environments must be safeguarded against clandestine diversion to weapons production. A problem of particular importance is safeguarding large storage tanks or cylinders of uranium hexafluoride ($UF_6$). There are presently approximately 10,000 such cylinders which must be periodically inspected by the International Atomic Energy Agency to insure that a significant amount of $UF_6$ has not been drawn off and diverted. In order to do this, it is necessary to have a means for sealing the tank valve in a manner which will reveal any tampering. Presently, some $UF_6$ cylinder valves are sealed, but the seals are not sufficiently tamper-indicating and they require examination in a laboratory to determine if tampering has occurred.

Thus, it is an object of the subject invention to provide an inexpensive, uncomplicated apparatus for forming a more definitive tamper-indicating seal.

It is a further object of the subject invention to provide an apparatus for forming a tamper indicating seal which may be verified as intact by a field inspection.

BRIEF SUMMARY OF THE INVENTION

The above objects are achieved and the disadvantages of the prior art are overcome by the subject invention by means of an apparatus for forming a tamper-indicating seal comprising a first shrinkable tube having a first visible pattern of markings, and a second transparent shrinkable tube having a second pattern of markings. The first tube is sized so that it will fit over the item to be sealed and may be shrunk to cling tightly to that item while the second tube is sized to fit over the item and the first tube, so that it may be shrunk to cling tightly then to form a tamper indicating seal. After the seal is formed the relationship between the first and second patterns may be noted so that any attempt to remove and replace the seal may be detected.

In a preferred embodiment, the first pattern is an arbitrary, irregular pattern, and the second pattern is a rectangular grid or other coordinate system. In another possible embodiment, the first pattern may comprise triangular markings so that the angular orientation of the markings with respect to the second pattern may be noted in addition to the relative positions of the patterns.

Thus, the subject invention advantageously provides an inexpensive apparatus for forming tamper-indicating seals.

It is a further advantage that such seals may be formed in the field by relatively inexperienced personnel using only simple equipment such as heat guns or small propane torches to shrink the tubing.

It is still a further advantage of the subject invention that the seal formed may be easily visually inspected in the field, thus requiring no laboratory verification.

Other objects and advantages of the subject invention will be apparent to those skilled in the art from a consideration of the detailed description set forthbelow and the attached drawings.

DETAILED DESCRIPTION

Figure 1:
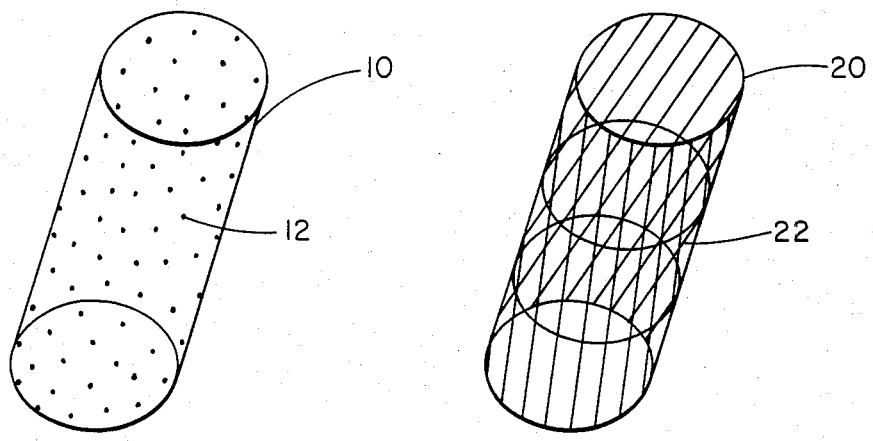
FIG. 1 shows one embodiment of an apparatus in accordance with the subject invention.

Turning to FIG. 1, there is shown an apparatus for forming a tamper-indicating seal comprising shrinkable tube 10 and transparent shrinkable tube 20. Tube 10 is marked with an arbitrary, irregular pattern 12. Transparent tube 20 is marked with a rectangular coordinate grid 22, which grid may be numbered (not shown). Pattern 12 should not be ordered, but should be irregular. Pattern 12, however, need not be random for each individual tube 10. Satisfactory patterns fo tube 10 may be produced by printing an arbitrary irregular pattern on a continuous length of shrinkable tubing. Thus, for example, if a pattern which repeats in a length of 10 feet were used and cut into lengths of approximately 6.3 inches, many different patterns would be produced. This feature of different starting patterns of dots for the transparent tubes is not essential, since the final random pattern arises in large part from the random shrinking process. However, different starting patterns increase the total number of distinguishable patterns from a number in the order of hundreds to a number in the order of thousands. The higher this number, the more difficult it is for a tamperer to duplicate the patterns through multiple attempts. Of course, completely random starting patterns 12 would be even more difficult to reproduce and might provide an extra element of security for applications which would justify the expense of generating an individual random pattern 12 for each tube 10 produced.

Figure 2:
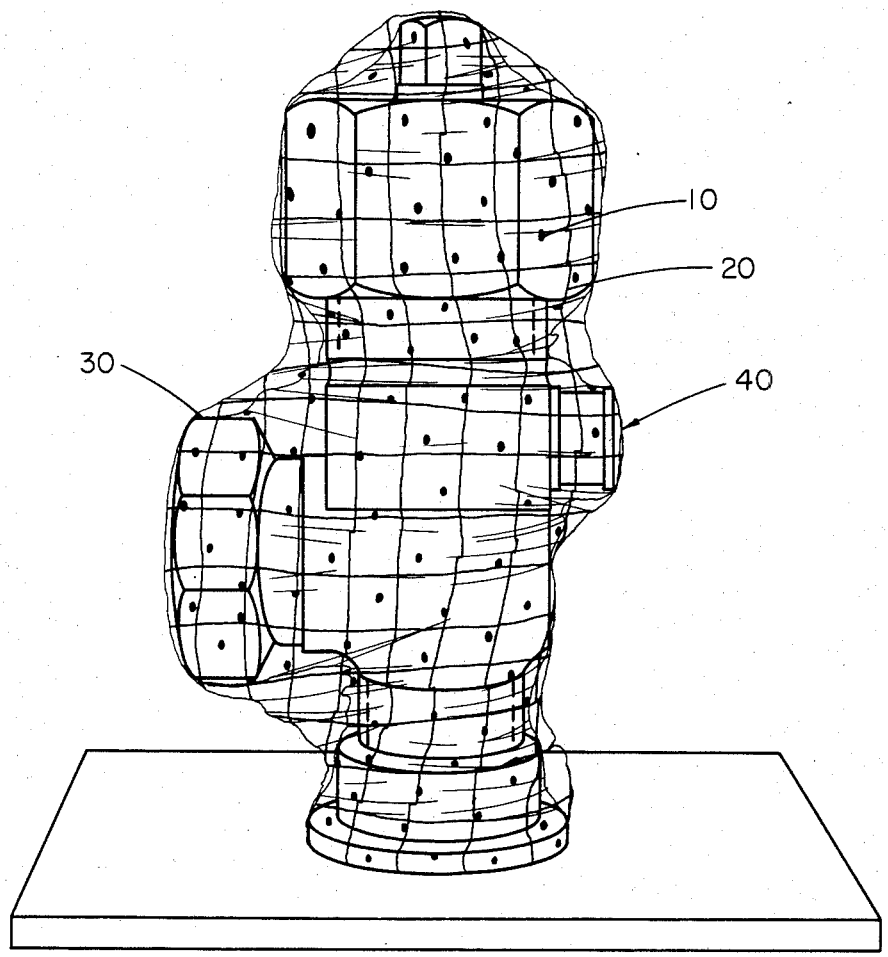
FIG. 2 shows a seal formed in accordance with the subject invention.

Turning to FIG. 2, the formation of a tamper-indicating seal using the apparatus of the subject invention is illustrated. Tube 10 is placed over item 30 to be sealed and shrunk until it clings tightly to item 30. In FIG. 2, item 30 is shown as a valve for illustrative purposes. However, seals may be formed for numerous different types of items such as padlocks, containers and electronic components. Transparent tube 20 is then placed over item 30 with tube 10 shrunk on it and tube 20 is shrunk until it clings tightly. Tubes 10 and 20 may readily be shrunk in the field by the application of heat from a source such as a heat gun or a small propane torch. A completed seal in accordance with the subject invention is shown in FIG. 2. Due to random variations in the way tubes 10 and 20 are heated, the relative orientations of the patterns 12 and 22 of tubes 10 and 20 over the irregular surface of item 30 creates an essentially random and irreproducible pattern each time a seal is formed using the apparatus of the subject invention. If this combined pattern is chosen and recorded by an inspector, any attempt to tamper with sealed item 30 may be detected since removal and replacement of the seal would almost inevitably produce a different combined pattern which could easily be detected in the field by a simple visual inspection.

Figure 3:
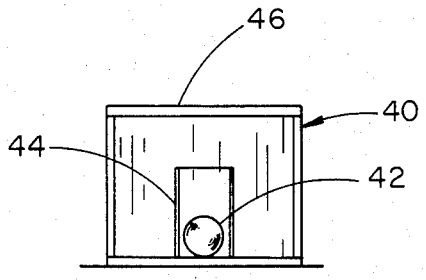
FIG. 3 shows a tip indicator used in one embodiment of the subject invention.

In another embodiment of the subject invention, the assembly of the subject invention may further comprise a motion indicating device which may be fastened to the item to be sealed and secured with the seal of the subject invention. A suitable motion indicating device would be a tip indicator 40, shown attached to item 30 in FIG. 2. Such tip indicators are known, commercially available devices and are shown in FIG. 3. They comprise a ball 42 retained in a cup 44 enclosed in a transparent housing 46. The clearance between cup 44 and housing 46 is only slightly greater than the diameter of ball 42 so that if indicator 40 is tipped sufficiently so that ball 42 falls out of cup 44 it is extremely difficult to restore it to cup 44 without penetrating shrunk tubes 10 and 20 and breaking open housing 46. Tip indicator 40 would reveal, for example, any attempt to unscrew a sealed valve from the valve seat without removing the seal. Of course, numerous other types of more sophisticated tip and motion detectors may be used in combination with the subject seals in this embodiment of the subject invention.

The above detailed description and the attached drawings are provided by way of illustration and example only. Other embodiments within the scope of the subject invention will be apparent to those skilled in the art. Thus, the scope of the subject invention is defined only by the claims set forth below.

We claim:

1. An apparatus for forming a tamper-indicating seal comprising:

(a) a first heat shrinkable tube sized to fit over an item to be sealed and capable of being shrunk to cling tightly to such item, said first tube having a first pattern of visible markings; and, (b) a second, transparent heat shrinkable tube sized to fit over such item and said first tube after said first tube has been shrunk onto such item and randomly heated over its outer expanse, so as to be shrunk to cling tightly to said first tube and such item so as to form a seal, said second tube having a second pattern of markings that differs from said first pattern such that after said seal is formed the relationship between said first and second patterns produces an essentially unique random pattern that may be noted so that any attempt to remove and replace said seal will produce a change in said unique random pattern, which change may be detected.

2. An apparatus as described in claim 1, wherein said first pattern is an irregular, pseudorandom pattern and said second pattern is a coordinate system.

3. An apparatus as described in claim 1, wherein said first pattern is a random pattern and said second pattern is a coordinate system.

4. An apparatus as described in claim 1 further comprising a motion indicator which may be secured to an item to be sealed as a part of the seals formed from said apparatus.

5. A tamper-indicating seal for securing an item comprising:

(a) a first heat shrinkable tube shrunk to cling tightly to such item, said tube having a first visible pattern of markings; and (b) a second, transparent heat shrinkable tube that has been randomly heated over its outer expanse so as to be shrunk to cling tightly to said first tube and such item, said second tube having a second pattern of visible markings that differ from said first pattern, whereby the relationship between said first and second patterns produces an essentially unique random pattern that may be noted so that said seal may not be removed and a new seal substituted without producing a change in said unique random pattern, which change affords ready detection of an attempt to remove or substitute the seal.

6. A seal as described in claim 5, wherein said first pattern is an irregular pseudorandom pattern and said second pattern is a coordinate system.

7. A seal as described in claim 5, wherein said first pattern is a random pattern and said second pattern is a coordinate system.

8. A seal as described in claim 5 further comprising a motion indicator secured to such item by said tubes.

9. A method for securely sealing an item, comprising the steps of:

(a) shrinking a first shrinkable tube to cling tightly to at least one irregular surface of such item, said first tube having a first pattern of visible markings; and (b) shrinking a second, transport shrinkable tube by applying randomly over its outer expanse varied heat, thereby causing the second tube to cling tightly to such item and said first tube, said second tube having a second pattern of markings that differs from said first pattern, the relative orientation of said randomly heated first and second tubes over said irregular surface creating another essentially random and unique pattern, whereby the relationship between said first and second patterns may be noted as said essentially random and unique pattern, so that the seal so formed may not be removed and another substituted without detection.

10. A method as described in claim 9, wherein said first pattern is an irregular pseudorandom pattern and said second pattern is a coordinate system.

11. A method as described in claim 9, wherein said first pattern is a random pattern and said second pattern is a coordinate system.

12. A method as described in claim 9 comprising the further step of attaching a motion indicator to such item prior to shrinking the first shrinkable tube into said item.

* * * * *